US009541338B2

(12) United States Patent
Cooney

(10) Patent No.: US 9,541,338 B2
(45) Date of Patent: Jan. 10, 2017

(54) METHOD FOR CONTROLLING AN EXPANSION RELIEF HEADER FOR PROTECTING HEAT TRANSFER COILS IN HVAC SYSTEMS

(71) Applicant: Robert Cooney, Phoenixville, PA (US)

(72) Inventor: Robert Cooney, Phoenixville, PA (US)

( * ) Notice: Subject to any disclaimer, the term of this patent is extended or adjusted under 35 U.S.C. 154(b) by 200 days.

(21) Appl. No.: 14/613,448

(22) Filed: Feb. 4, 2015

(65) Prior Publication Data

US 2015/0144322 A1 May 28, 2015

Related U.S. Application Data

(63) Continuation of application No. 14/071,022, filed on Nov. 4, 2013, now Pat. No. 9,448,018.

(60) Provisional application No. 61/727,799, filed on Nov. 19, 2012.

(51) Int. Cl.

| | |
|---|---|
| ***F28F 27/00*** | (2006.01) |
| ***F28F 19/00*** | (2006.01) |
| ***F28F 9/02*** | (2006.01) |
| ***F28D 1/047*** | (2006.01) |
| ***F28D 1/02*** | (2006.01) |

(52) U.S. Cl.

CPC ..... *F28F 27/00* (2013.01); *F28D 1/02* (2013.01); *F28D 1/0477* (2013.01); *F28F 9/02* (2013.01); *F28F 9/0231* (2013.01)

(58) Field of Classification Search

CPC ..... F28F 27/00; F28F 9/0231; F28F 9/02; F28D 1/00; F28D 1/04772

USPC ..... 165/71, 104.27, 134.1, 287

See application file for complete search history.

(56) References Cited

U.S. PATENT DOCUMENTS

| | | | | |
|---|---|---|---|---|
| 443,873 | A | 12/1890 | Snow | |
| 1,018,354 | A | 2/1912 | Fairfield | |
| 1,125,063 | A | 1/1915 | Colberg | |
| 1,159,225 | A | 11/1915 | Howell | |
| 1,184,198 | A * | 5/1916 | Morison | F01P 11/0276 165/71 |
| 1,274,988 | A | 8/1918 | Chadwick | |

(Continued)

FOREIGN PATENT DOCUMENTS

| | | |
|---|---|---|
| AU | 7282681 | 7/1981 |
| CH | 169433 | 5/1934 |

(Continued)

OTHER PUBLICATIONS

European Extended Search Report for EP 13 19 2012.6 dated Nov. 18, 2014, 9 pgs.

*Primary Examiner* — Len Tran
*Assistant Examiner* — Claire Rojohn, III
(74) *Attorney, Agent, or Firm* — Drinker Biddle & Reath LLP

(57) ABSTRACT

An expansion relief header and its method of operation are disclosed for use in an HVAC heat transfer coil. The expansion relief header includes a main body adapted to be secured to bends in fluid coils of the HVAC fluid tube system. The main body includes holes in alignment with holes formed in the bends to enable fluid to pass from the bends into the expansion relief header. The expansion relief headers include one or more relief devices, such as valves, that automatically open, preferably in response to pressure exceeding a predetermined threshold value or temperature falling below a predetermined value, to release fluid from the expansion relief header and then reseat themselves.

18 Claims, 3 Drawing Sheets

(56) References Cited

U.S. PATENT DOCUMENTS

| | | | | | |
|---|---|---|---|---|---|
| 1,554,344 | A | | 9/1925 | Haapanen | |
| 1,573,157 | A | | 2/1926 | Giddings, Jr. | |
| 1,900,836 | A | | 3/1933 | Merritt | |
| 2,012,361 | A | | 8/1935 | Thomas | |
| 2,269,895 | A | | 1/1942 | Foster | |
| 2,526,794 | A | | 10/1950 | Andrews | |
| 2,580,426 | A | | 1/1952 | Heigis | |
| 2,915,216 | A | | 12/1959 | Coffman | |
| 2,975,983 | A | | 3/1961 | Niebling | |
| 3,080,091 | A | | 3/1963 | Philip | |
| 3,090,433 | A | | 5/1963 | Amorosi et al. | |
| 3,319,657 | A | * | 5/1967 | Nyiri | F16L 55/00 137/59 |
| 3,825,060 | A | * | 7/1974 | Heller | F01K 9/00 137/520 |
| 3,844,310 | A | | 10/1974 | Brindisi | |
| 4,006,775 | A | | 2/1977 | Avrea | |
| 4,047,561 | A | | 9/1977 | Jaster et al. | |
| 4,146,047 | A | | 3/1979 | Wood et al. | |
| 4,269,214 | A | | 5/1981 | Forsythe et al. | |
| 4,316,624 | A | | 2/1982 | Davlin | |
| 4,458,138 | A | | 7/1984 | Adrian et al. | |
| 4,549,565 | A | | 10/1985 | Short, III | |
| 4,770,446 | A | | 9/1988 | Keller | |
| 4,928,754 | A | * | 5/1990 | Westerberg | E03B 7/10 137/59 |
| 5,074,282 | A | * | 12/1991 | Reed | F24J 2/26 126/588 |
| 5,213,378 | A | | 5/1993 | MacGregor | |
| 5,477,848 | A | * | 12/1995 | Reed | F24J 2/26 126/659 |
| 5,558,158 | A | * | 9/1996 | Elmore | A61L 9/20 165/122 |
| 5,579,828 | A | | 12/1996 | Reed | |
| 5,660,050 | A | * | 8/1997 | Wilson | F25B 39/04 165/110 |
| 5,697,546 | A | | 12/1997 | Cicioni | |
| 6,119,729 | A | | 9/2000 | Oberholzer | |
| 6,173,767 | B1 | * | 1/2001 | Kennon | F16K 17/16 137/68.23 |
| 6,213,200 | B1 | * | 4/2001 | Carter | F28C 1/14 165/110 |
| 2003/0024692 | A1 | * | 2/2003 | Wu | F25B 39/04 165/115 |
| 2006/0278379 | A1 | * | 12/2006 | Molavi | F28D 7/16 165/143 |
| 2010/0170210 | A1 | | 7/2010 | McClanahan et al. | |
| 2010/0290190 | A1 | | 11/2010 | Chester et al. | |

FOREIGN PATENT DOCUMENTS

| | | | |
|---|---|---|---|
| DE | 102005030633 | A1 | 1/2007 |
| EP | 0454559 | A1 | 10/1991 |
| EP | 1215462 | A2 | 6/2002 |
| EP | 1528346 | A2 | 5/2005 |
| GB | 297270 | | 9/1928 |
| WO | 2009046565 | A1 | 4/2009 |

* cited by examiner

METHOD FOR CONTROLLING AN EXPANSION RELIEF HEADER FOR PROTECTING HEAT TRANSFER COILS IN HVAC SYSTEMS

RELATED APPLICATION

The present application is a continuation of U.S. patent application Ser. No. 14/071,022, filed on Nov. 4, 2013, and claims priority from U.S. Provisional Application No. 61/727,799, filed Nov. 19, 2012. The disclosures of both applications are incorporated herein by reference in their entirety.

FIELD OF THE INVENTION

The present invention is directed to devices for use on heating, ventilating and air conditioning (HVAC) systems that prevent fluid tubes in the HVAC system from splitting when the fluid expands. In particular invention is directed to devices that allow for fluid expansion, and possibly fluid removal with the use of temperature and/or pressure relief devices.

BACKGROUND OF THE INVENTION

Fluid tubes are commonly used in HVAC systems, primarily in air handlers and similar cooling or heating systems. These systems are commonly used with cool or hot water, but could also be used to condense steam into a liquid in a heating system. Typically, these HVAC systems have a heat transfer medium, in the form of fluid. As used herein the term "fluid" covers both liquid and steam. The fluid circulates throughout tubes to acquire or lose heat. The common industry term for these HVAC heat transfer components is coils. The tubes in the coils are subject to damage when the fluid in the tubes are exposed to wide temperature differences, and as a result, is subject to changes in state. In the case of water, for instance, it will change from a liquid to a solid (ice) at low temperatures. At temperatures at or below 32 degrees F., the water in the tubes is subject to freezing and the expansion of the water may result in splitting of the tubes.

Historically, ice masses form inside the tubes and expand outward creating excessive pressure in the tubes and at the return bends. The effect of freezing may cause the tubes to expand and split. Upon thawing, the water is released through the damaged return bends thus flooding the air handler, an area around the air handler on the level the air handler resides, and any levels below. This may create a series of expensive repairs, not only to the tube and the frozen equipment but now to all building components that are around and below the area of the flooding. In addition, costly shut down time of offices, manufacturing spaces, labs and all other building areas can result. This shut down time of operations of any facility requires emergency measures with possible excessive costs depending on the sensitivity of the operations involved.

Past tube or return bend damage prevention has taken the form of bladders, freeze plugs and various other devices. The use of these devices presents many problems to the maintainers of these systems. First and foremost, these devices, once they are activated, require labor to repair or replace. Furthermore, freeze plugs which are designed to blow out in the event of excessive pressure caused by freezing, which results in flooding after the blow out of the plugs upon thawing of the ice.

SUMMARY OF THE INVENTION

A method for controlling a device designed for the condition where the water (or other fluid medium) in tubes of an HVAC system changes from a liquid state (water) to a solid state (ice). The device includes piping expansion relief headers arranged to connect to bends in the tubes and to allow the water to enter the expansion relief header and to permit pressure to build within the expansion relief header as the water in the tubes expands during freezing in order to prevent damaging (e.g., splitting) of the tubes. The piping expansion relief headers include one or more relief devices, such as valves, that are configured to automatically release fluid from the expansion relief header when the pressure within the expansion relief header exceeds a predetermined value or the temperature of the fluid is below a predetermined value so as to prevent damage to the tubes and return bends. The expansion relief headers with the relief devices, are configured to work repeatedly over many periods of freezing and thawing and also over many periods of changes in pressure with minimum human intervention and minimum need for maintenance. The use of the expansion relief headers with relief devices (valves) enables an HVAC system to be "freeze safe" or "change of state safe".

It is to be understood that both the foregoing general description and the following detailed description are exemplary and explanatory and are intended to provide further explanation of the invention as claimed.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DESCRIPTION OF THE INVENTION

Figure 1:
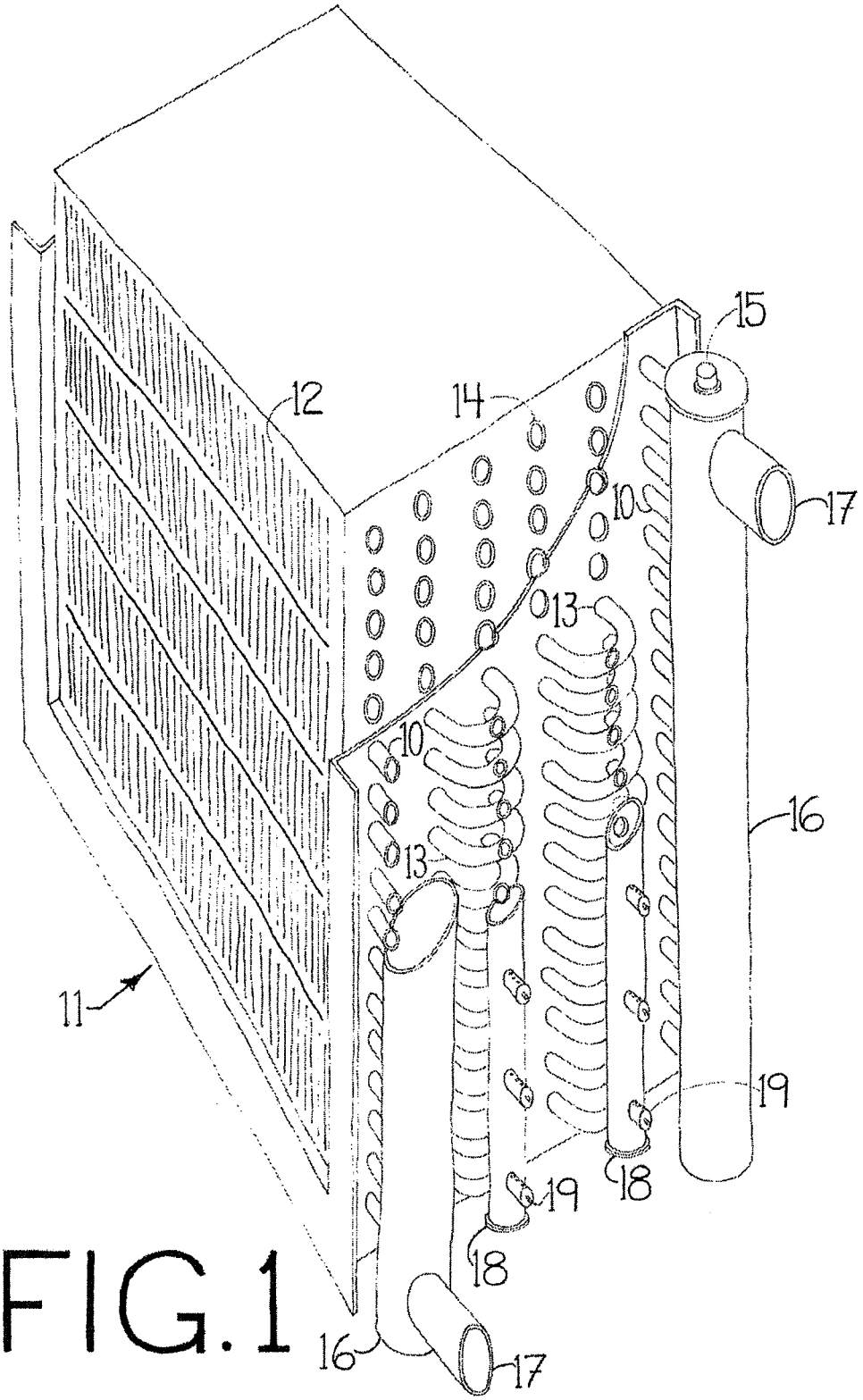
FIG. 1 is a general perspective representation of coil assembly including the relief system according to the present invention.
Figure 2:
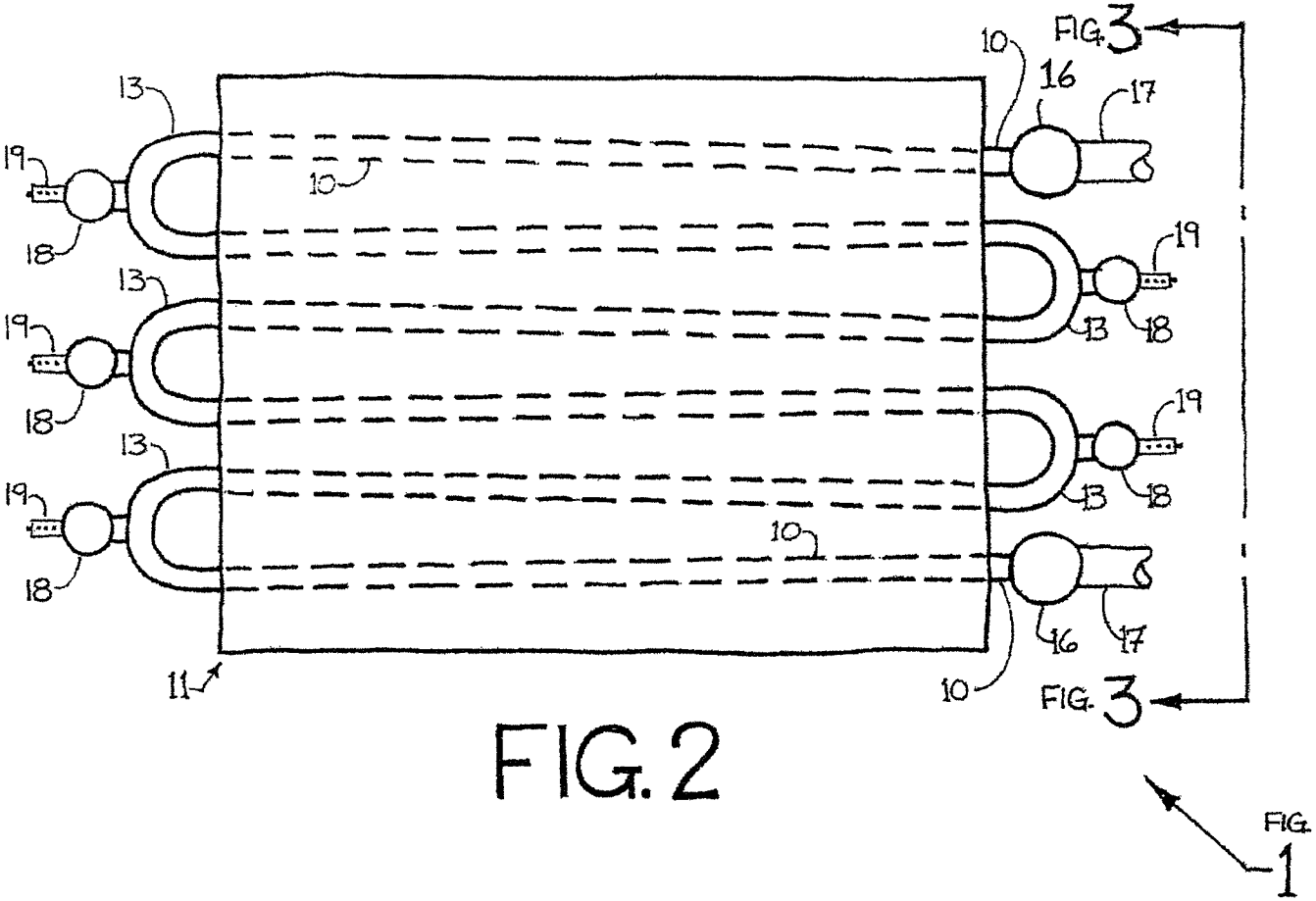
FIG. 2 is a top view of an expansion relief header in the coil assembly of FIG. 1.
Figure 3:
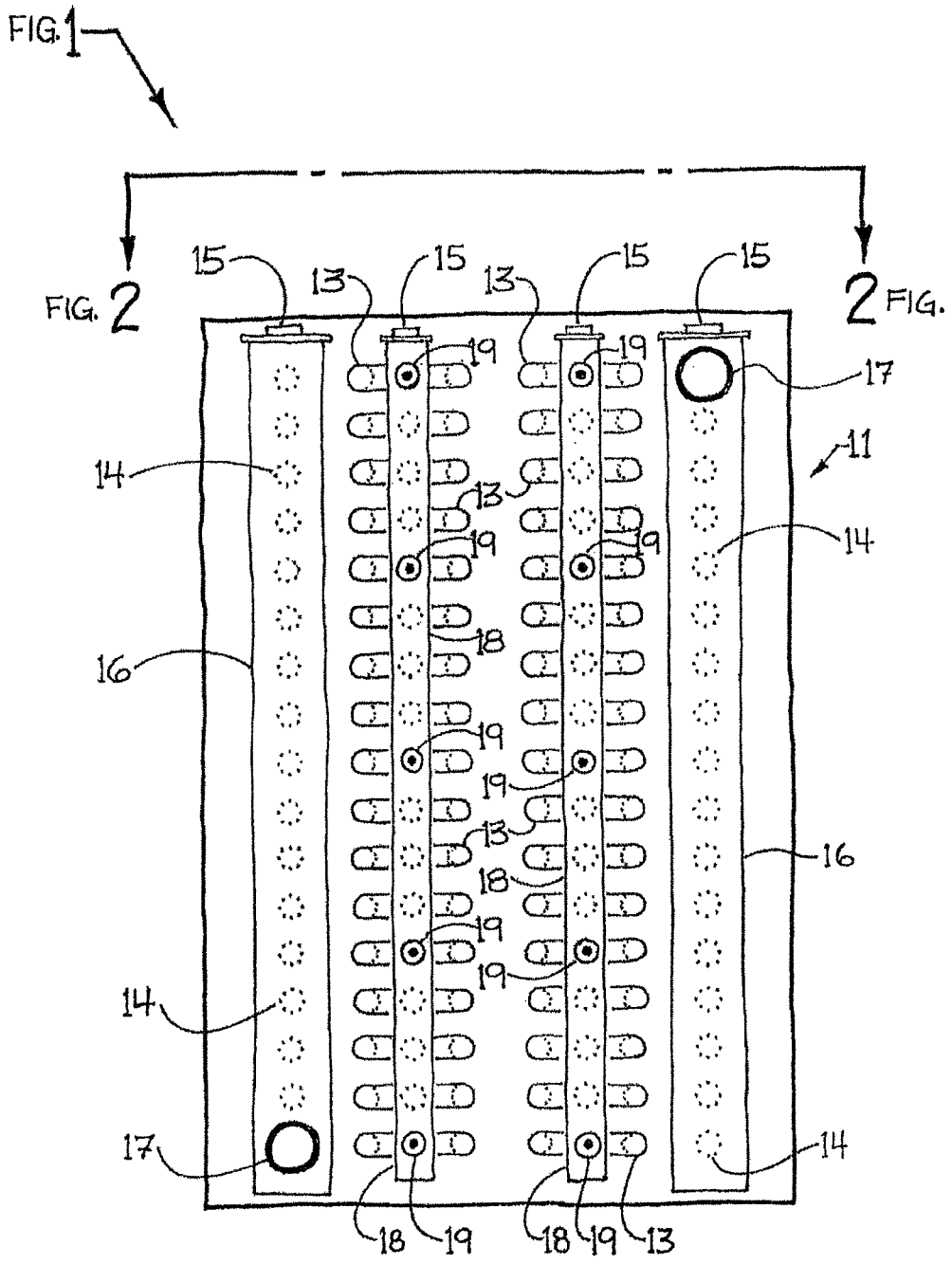
FIG. 3 is a side view of an expansion relief header in the coil assembly of FIG. 1.

FIGS. 1-3 illustrate various views of an example embodiment of an expansion relief header utilized on an HVAC heat transfer coil. The use of the expansion relief header provides an HVAC system that is "freeze safe". The expansion relief header enables fluid to flow out of the tubes and into an additional volume or area to accommodate fluid expansion caused by a change in fluid state (e.g., water turning to ice). The expansion relief header may also provide additional pressure relief from expansion and/or phase change of the fluid used in the tubes. The expansion relief header not only relieves pressure to protect the return bends of the fluid tubes but also allows for the resealing after expansion.

FIG. 1 illustrates a perspective view of an example expansion relief header utilized on an HVAC heat transfer coil. As illustrated, various elements of the HVAC heat transfer coil are "cut away" to make it clear to the observer the basic ideas of this "change of state safe" system. The HVAC heat transfer coil includes a system casing 11 that has fins 12 formed therein for heat transfer. The casing 11 also has holes 14 running there through that secure fluid tubes 10. Fluid tube return bends 13 are utilized to connect fluid tubes 10. Piping 17 is utilized to supply/return fluid to main headers 16 that feed the fluid tubes 10 (e.g. supply on right side and return on left side). The main headers 16 include vent connections 15 for air removal and/or draining.

The expansion relief headers 18 are configured to align with and connect to the bends 13. The expansion relief headers 18 may include holes, connectors or the like (not separately numbered) in alignment with the bends 13. The bends 13 may have holes (not separately numbered) formed therein. The alignment of the holes in the expansion relief headers 18 and the holes in the bends 13 allows for fluid expansion from the tubes 10 into the expansion relief headers 18 if and when necessary. The expansion relief headers 18 may also include vent connections 15 for air removal and/or draining (not separately numbered). The expansion relief headers 18 may include holes or connectors (not separately numbered) for receiving relief devices 19. The relief devices 19 may be on opposite side of the holes in alignment with the bends 13. The relief devices 19 may open to allow fluid to escape from the expansion relief headers 18 if additional fluid expansion is necessary. The relief devices 19 may include temperature and/or pressure relief devices designed to open at set values (e.g., temperature, pressure) so that a portion of the liquid will be dispersed and the tubes 10 are "change of state safe". The number of relief devices 19 utilized may vary depending on various parameters, including the size, shape and type of unit and the anticipated environmental (e.g., weather) conditions. The relief devices 19 may automatically reseal after opening for fluid expansion (once the pressure and/or temperature returns to a certain value). In an alternative embodiment, the relief devices 19 may not automatically reseal after being opened for fluid expansion. These types of relief devices may need to be replaced and/or reset after opening or risk leakage of fluid therefrom even when fluid expansion is not required.

FIG. 2 illustrates a top view of an example expansion relief header utilized on an HVAC tube system. The tubes 10 run through the system and the bends 13 connect adjacent tubes 10. The piping 17 is utilized to supply/return fluid to main headers 16 that feed a single column of fluid tubes 10 on each side of the device. The expansion relief headers 18 are connected to the bends 13 and may have one or more relief devices 19 connected thereto.

FIG. 3 illustrates a side view of an example expansion relief header utilized on an HVAC tube system. The main headers 16 are mounted on each side of the system. The main header 16 on the right has the piping 17 connected to the top in order to supply the liquid while the main header 16 on the left has the piping 17 connected to the bottom in order to return the liquid. The main headers 16 include vent connections 15 for air removal and/or draining. Note, the vent connections 15 are only illustrated on the top for ease of illustration but would also be included on the bottom. The expansion relief headers 18 are connected to each of the bends 13 and may include a plurality of relief devices 19.

The present invention provides a significant advance over prior systems since it incorporates a valve which is preferably selected with material properties similar to metals used in the majority of HVAC coils. As this valve requires a double seat (one for the spring and one for the thermal element), the inventor determined, after experimentation, that brass or alloy may be a more preferable material to plastic as it is far more durable and can handle the pressure generated by the heavy spring design required in this particular invention. Typically the valve is installed on the expansion relief header approximately six inches from the bottom of the header, which is above the drain and therefore less prone to clogging in the event that particulate deposits at the bottom of the header during the life of the coil. In some embodiments, used multiple valves have been incorporated per expansion relief header depending on the overall height of the coil. However, one valve per expansion relief header is sufficient for the majority of the installations.

In one preferred embodiment, the present invention combines two relief features: an automatically re-seating temperature and pressure relief valve, and expansion relief headers. This design does not necessarily prevent a coil from freezing, which was thought to be the only possible solution in the past. With the present invention, the fluid in a coil is permitted to freeze without causing any bursting. The pressure in the expansion relief header portion of the invention, which links the coil tubes together at the return bends, increases as the ice masses form in the tubes that are in the face of the coil/air stream. As the pressure increases, the relief device(s) 19, which is preferably a combination pressure-temperature valve, that is connected to the expansion relief header releases a small amount of water and then re-seats itself when the pressure drops below and/or temperature rises above a predetermined value. This controlled relief protects the coils from bursting upon freezing, thus reducing related coil damage and subsequent flooding.

In one embodiment, the pressure-temperature valve is selected with a pressure relief setting (opening) of approximately 150 psi, which is between the normal operating pressures of a typical HVAC system (i.e., approximately 30 to 130 psi) and the typical tubing burst pressures (approximately 1,500 to 3,000 psi). This has proven to be effective in actual customer beta test sites and factory wind tunnel experiments and testing.

In the preferred embodiment, the valve is selected with a temperature setting of approximately 35° F. where the valve will open to release excess cold water as an added layer of protection. The industry standard temperature for chilled water being supplied to a coil typically does not go below 40° F. Therefore, when temperatures drop below this standard, the valve further protects the coil by sensing the internal (and, if desired, can sense external) temperatures, thus allowing a small volume of water to bleed off when the internal temperature drops below 35° F. The amount of water released can be preset or the valve can reseat upon the temperature rising above 35° F.

It is to be understood that even though numerous characteristics and advantages of the present invention have been presented above, together with details of the structure and function of the invention, the disclosure is illustrative only and changes may be made in detail, especially in matters of shape, size and arrangement of parts within the principles of the invention to the full extent indicated by the broad general meaning of the terms in which the appended claims are expressed.

What is claimed:

1. A method of controlling an HVAC coil in an air handler comprising the steps of:

providing a HVAC heat transfer coil, the coil including a housing having a top, a bottom and opposed vertical sides;

a plurality of fluid tubes extending through the housing from one side to the other, each tube having a plurality of fins attached thereto for heat transfer;

a plurality of bends extending out of the sides, each bend connected to ends of adjacent fluid tubes to form a fluid passage there between;

at least one expansion relief header extending vertically downward from the top of the housing toward the bottom of the housing, the expansion relief header mounted to the plurality of aligned bends through a plurality of fluid passages so that each fluid passage permits fluid to flow between one of the bends and the relief header, the relief header positioned on the coils so that the fluid fills a portion of the relief header during operation between a lowermost bend and an uppermost bend; and at least one relief valve mounted directly to the relief header at a location below the top of the housing where the fluid fills a portion of the relief header so that the valve is in direct communication with the fluid in the relief header during operation and not in communication with an air pocket or expansion tank installed outside of the air handler such that the valve will automatically immediately release fluid from the relief header without any release of air when fluid pressure within the expansion relief header exceeds a predetermined value; and wherein the valve has an open position where fluid is allowed to flow out from the expansion relief header and a closed position where fluid is prevented from flowing out from the expansion relief header, the valve including a first sensor that senses pressure of the fluid within the expansion relief header for controlling the opening and closing of the valve, and a second sensor that senses the temperature of the fluid within the expansion relief header for controlling the opening and closing of the valve;

allowing fluid to fill the coil and at least a portion of the relief header to a level above the valve so that the valve is in direct communication with the fluid in the relief header and not in communication with an air pocket or expansion tank installed outside of the air handler;

sensing the fluid pressure within the expansion relief header with the first sensor;

releasing fluid through the valve when the sensed fluid pressure within the expansion relief header exceeds a threshold value; and stopping the release of fluid through the valve when the sensed fluid pressure within the expansion relief header falls below a predetermined value or the sensed temperature within the expansion header is above a predetermined value.

2. The method of controlling an HVAC coil according to claim 1, wherein the valve extends laterally from a side of the expansion relief header.

3. The method of controlling an HVAC coil according to claim 1, wherein the releasing of fluid through the valve occurs when the sensed fluid pressure is at or exceeds about 150 psi.

4. The method of controlling an HVAC coil according to claim 1, wherein the threshold fluid pressure value at which point the valve opens is at least about 150 psi.

5. The method of controlling an HVAC coil according to claim 1, wherein the releasing of fluid through the valve is stopped when the sensed fluid pressure is at or below about 150 psi.

6. The method of controlling an HVAC coil according to claim 1, wherein the releasing of fluid through the valve is stopped when the sensed temperature is at or above the freezing temperature of the fluid.

7. The method of controlling an HVAC coil according to claim 1, wherein the releasing of fluid through the valve is stopped when the sensed fluid pressure is at or below about 150 psi and the sensed temperature is at or above the freezing temperature of the fluid.

8. The method of controlling an HVAC coil according to claim 1, further comprising the step of providing an audible or visual signal upon opening of the valve.

9. The method of controlling an HVAC coil according to claim 1, wherein the stopping of the release of fluid through the valve occurs when both the sensed fluid pressure within the expansion relief header falls below a predetermined value and the sensed temperature within the expansion header is above a predetermined value.

10. A method of controlling expansion of fluid in an HVAC coil of an air handler, the method comprising the steps of:

providing a HVAC heat transfer coil, the coil including a housing having a top, a bottom and opposed vertical sides;

a plurality of fluid tubes extending through the housing from one side to the other, each tube having a plurality of fins attached thereto for heat transfer;

a plurality of bends extending out of the sides, each bend connected to ends of adjacent fluid tubes to form a fluid passage there between;

at least one expansion relief header mounted along the vertical side of the housing so that the expansion relief header extends vertically from the top of the housing toward the bottom of the housing, the expansion relief header mounted to the plurality of aligned bends with a fluid passage extending between each bend and the expansion relief header so as to permit fluid to flow between each bend and the relief header, the relief header positioned on the coils so that the fluid fills the relief header during operation between a lowermost bend and an uppermost bend; and at least one relief valve mounted directly to the relief header at a location below the uppermost bend so that the valve is in direct communication with the fluid in the relief header during operation such that the valve will immediately release fluid from the relief header without any release of air when fluid pressure within the expansion relief header exceeds a predetermined value;

the valve having an open position where fluid is allowed to flow out from the expansion relief header and a closed position where fluid is prevented from flowing out from the expansion relief header, the valve including a first sensor that senses the pressure of the fluid within the expansion relief header for controlling the opening and closing of the valve, and a second sensor that senses the temperature of the fluid within the expansion relief header for controlling the opening and closing of the valve;

filling the coil and at least a portion of the relief header to a level above the valve so that the valve is in direct communication with the fluid in the relief header and not in communication with an air pocket or expansion tank installed outside of the air handler;

sensing fluid pressure within the expansion relief header with the first sensor;

opening the valve so as to release fluid through the valve when the sensed fluid pressure within the expansion relief header exceeds a threshold value; and closing the valve so as stop the release of fluid through the valve when the sensed fluid pressure within the expansion relief header falls below a predetermined value or the sensed temperature within the expansion header is above a predetermined value.

11. The method of controlling expansion of fluid in an HVAC coil according to claim 10, wherein the valve extends laterally from a side of the expansion relief header.

12. The method of controlling expansion of fluid in an HVAC coil according to claim 10, wherein the opening of the valve occurs when the sensed fluid pressure is at or exceeds about 150 psi.

13. The method of controlling expansion of fluid in an HVAC coil according to claim 10, wherein the predetermined fluid pressure value at which point the valve release fluid is at least about 150 psi.

14. The method of controlling expansion of fluid in an HVAC coil according to claim 10, wherein the closing of the valve occurs when the sensed pressure is at or below about 150 psi.

15. The method of controlling expansion of fluid in an HVAC coil according to claim 10, wherein the closing of the valve occurs when the sensed temperature is at or above the freezing temperature of the fluid.

16. The method of controlling expansion of fluid in an HVAC coil according to claim 10, wherein the closing of the valve occurs when the sensed pressure is at or below about 150 psi and the sensed temperature is at or above the freezing temperature of the fluid.

17. The method of controlling expansion of fluid in an HVAC coil according to claim 10, further comprising the step of providing an audible or visual signal upon opening of the valve.

18. The method of controlling expansion of fluid in an HVAC coil according to claim 10, wherein the closing of the valve occurs when both the sensed pressure within the expansion relief header falls below a predetermined value and the sensed temperature within the expansion header is above a predetermined value.

* * * * *